US010743676B1

(12) United States Patent
Galjour

(10) Patent No.: US 10,743,676 B1
(45) Date of Patent: Aug. 18, 2020

(54) METHOD AND APPARATUS FOR CUSHIONING THE JOINT BETWEEN ADJOINING PIECES OF FURNITURE

(71) Applicant: Benjamin Andrew Galjour, Tupelo, MS (US)

(72) Inventor: Benjamin Andrew Galjour, Tupelo, MS (US)

( * ) Notice: Subject to any disclaimer, the term of this patent is extended or adjusted under 35 U.S.C. 154(b) by 0 days.

(21) Appl. No.: 16/422,970

(22) Filed: May 25, 2019

(51) Int. Cl.
*A47C 13/00* (2006.01)
*A47C 31/00* (2006.01)
*A47C 1/124* (2006.01)

(52) U.S. Cl.
CPC ..... *A47C 31/00* (2013.01); *A47C 1/124* (2013.01); *A47C 13/005* (2013.01)

(58) Field of Classification Search
CPC ..... A47C 31/00; A47C 1/124; A47C 13/005
See application file for complete search history.

(56) References Cited

U.S. PATENT DOCUMENTS 3,944,281 A * 3/1976 Piretti ..... A47B 87/00 297/440.14
4,591,289 A * 5/1986 Vickers ..... A47B 87/002 108/64
5,352,017 A 10/1994 Berning
5,560,678 A * 10/1996 Eppelt ..... A47C 1/124 297/248
6,022,072 A 2/2000 Moyer
7,448,689 B2 11/2008 Carter et al.
8,950,817 B2 * 2/2015 Iacovoni ..... A47C 13/005 297/452.18
9,072,373 B2 * 7/2015 Hixson ..... A47C 13/005
10,349,746 B2 * 7/2019 Koehler ..... A47C 1/124
10,548,400 B2 * 2/2020 Paterson ..... A47C 13/005
2009/0045666 A1 2/2009 Westendorf
2010/0176643 A1 * 7/2010 Keaton, III ..... A47C 1/124 297/411.45
2019/0281973 A1 * 9/2019 Coates ..... A47C 1/124

FOREIGN PATENT DOCUMENTS

CN 106901540 A 6/2017
JP 3115059 U 9/2005

* cited by examiner

*Primary Examiner* — Philip F Gabler
(74) *Attorney, Agent, or Firm* — George L Williamson

(57) ABSTRACT

Method and apparatus for a device for cushioning the joint between two pieces of modular sectional furniture. The device has a top plate connected by a resilient member to a base support plate so that the base support plate can support the movable top plate so that when a user sits down on a piece of furniture made of individual joining sectional members the user will not feel discomfort from the space between the two pieces of furniture. The device is installed over adjacent frame members of the furniture.

16 Claims, 3 Drawing Sheets

METHOD AND APPARATUS FOR CUSHIONING THE JOINT BETWEEN ADJOINING PIECES OF FURNITURE

BACKGROUND OF THE INVENTION

Field of the Invention

The present invention relates generally to modular furniture and, more particularly, is concerned with a device for filling and cushioning the joint between adjoining pieces of modular furniture.

Modular furniture systems which include sectional piece sofas, love seats, combination sofas, reclining chairs, and bedding units, etc., have multiple pieces or sections which are positioned abutting each other in the conventional manner. When the sectional pieces are butted together with no additional cushioning, the individual sections have a seam/joint between them which is uncomfortable to one being seated on the piece of furniture.

Description of the Related Art

Devices relevant to the present invention have been described in the related art; however, none of the related art devices disclose the unique features of the present invention.

In U.S. Pat. No. 5,352,017 dated Oct. 4, 1994, Berning disclosed a modular furniture connecting apparatus. In U.S. Patent Application Publication No. 2009/0045666 dated Feb. 19, 2009, Westendorf, et al., disclosed a furniture member attachment system. In U.S. Pat. No. 7,448,689 dated Nov. 11, 2008, Carter, et al., disclosed a modular furniture attachment strap. In U.S. Pat. No. 6,022,072 dated Feb. 8, 2000, Moyer disclosed a debris collector for upholstered furniture. In Japanese Patent No. JP 3115059U dated Sep. 14, 2005, an unknown inventor (no translation available) disclosed a device closing the gap in the automotive seat. In Chinese Patent No. CN 106901540A dated Jun. 30, 2017, an unknown inventor (no translation available) disclosed a connecting piece for a sectional sofa.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses a device for providing filler and/or cushioning the joint which occurs at the point of joinder between two adjacent pieces of modular sectional furniture. The device has a floating top plate connected by a resilient member, e.g., coil springs, to a base support plate so that the base support plate can support the movable top plate so that when a user sits down on a piece of furniture made of individual adjoining members that the user will not feel discomfort caused by the space or seam/joint between the two pieces of adjoining sectional furniture. The present invention is somewhat elongated to extend from near the rear of the piece of furniture to near the front of the piece of furniture so as to provide the maximum comfort to the user.

An object of the present invention is to provide a member which fills the joint between adjoining sections of modular sectional furniture. A further object of the present invention is to provide a member which cushions the joint formed between adjoining members of modular sectional furniture.

A further object of the present invention is to prevent a user from feeling hard edges of wood or like material when he sits on a piece of furniture formed from adjoining members of modular sectional furniture. A further object of the present invention is to provide a member which can be easily operated and installed by a user. A further object of the present invention is to provide a furniture member which can be relatively easily and inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 2:
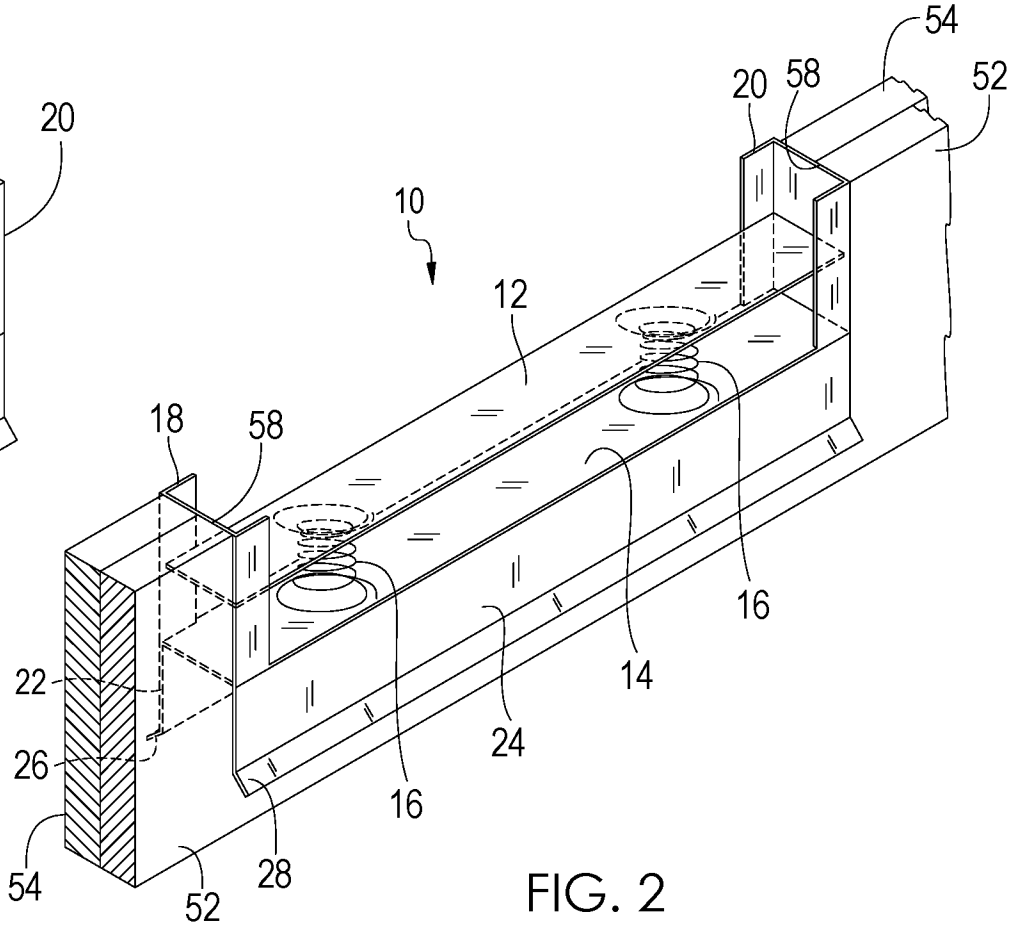
FIG. 2 is a perspective view of the present invention shown mounted on frame members with a coil spring.

With regard to reference numerals used, the following numbering is used throughout the drawings.

10 present invention
12 top plate
14 base support
16 coil springs
18 first end support
20 second end support
22 first upright leg
24 second upright leg
26 foot
28 foot
30 sofa
32 back
34 first end arm
36 second end arm
38 seating area
40 cushion
42 first section
44 second section

46 first end section
48 second end section
50 abutting seam or joint
52 first frame member
54 second frame member
56 user
58 notch
60 sinuous wire spring
62 end connection
64 foam

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 6 illustrate the present invention wherein a member is disclosed for filling and cushioning a joint/seam formed by adjoining members of modular furniture and which is generally indicated by reference number 10.

Figure 1:
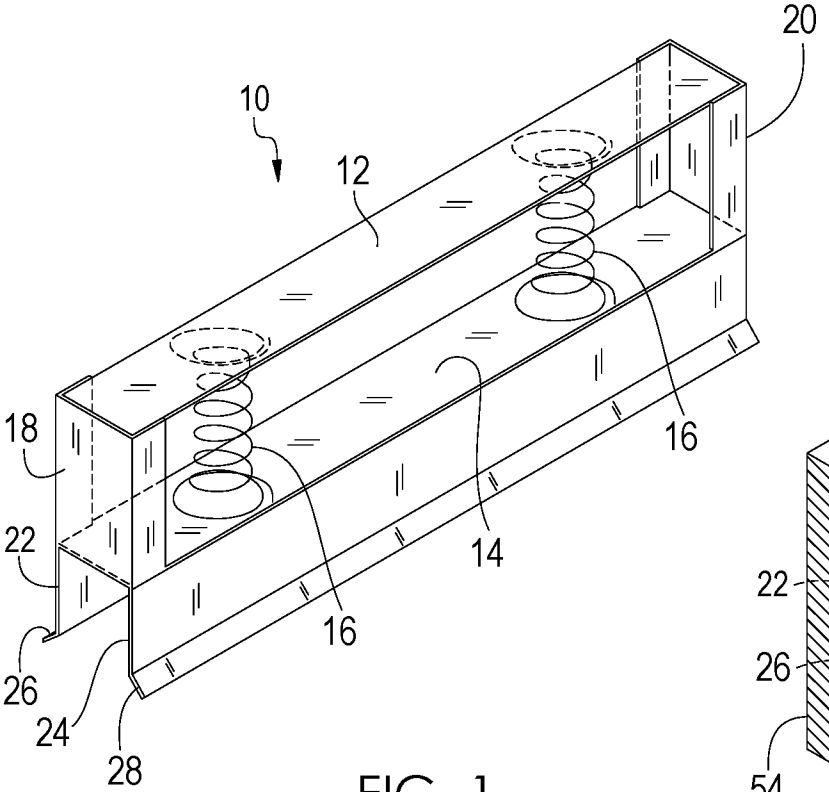
FIG. 1 is a perspective view of the present invention shown with coil springs.

Turning to FIG. 1, therein is shown the present invention 10 having a floating top plate 12 which is joined to a base support 14 by a plurality of coil springs 16 extending from an upper surface of the base support to underneath the top plate so that the top plate can move in a vertical plane while being supported by the base support 14. Also shown are left and right end supports 18, 20 forming inwardly disposed U-shaped channels and left and right upright legs 22, 24 extending downwardly from an underside of the base support plate 14 providing a downwardly disposed U-channel on an underside of the support plate. The present invention 10 is designed to support the top plate 12 using the base support 14 while having an effective number of springs 16 for cushioning extending between an underside of the base plate 12 and an upper side of the base support 14. Also shown are left and right supporting feet 26, 28 which add additional support to the upright legs 22, 24. The left and right supporting feet 26, 28 have outwardly bent tips for easing the installation of the present invention 10 as it is slid over the frame members 52, 54 (see FIG. 2) of the furniture piece. Coil springs 16 provide a resilient member thereby biasing the top plate 12 upwardly and providing resiliency, cushioning, and damping thereto when a user 56 (see FIG. 3) sits on the present invention 10.

Turning to FIG. 2, therein is shown the present invention 10 installed in a notch 58 on exemplary first and second frame members 52, 54 of a piece of furniture with the top plate 12 being slidably disposed inside the inwardly disposed U-channels formed in the first and second end supports 18, 20. Top plate 12 is shown moved about half way down the end supports 18, 20 due to the weight of a user being placed on its upper surface and pushing it downwardly along the U-shaped channels of the end supports 18, 20. First and second upright legs 24, 26 are flexible to some extent so that when they are placed on the frame members 52, 54 they squeeze the two frame members 52, 54 together and can be slid along the frame members so that the present invention 10 can be somewhat vertically height adjustable and adjustably placed along the longitudinal axis of the members 52, 54 to a user selected position.

Figure 3:
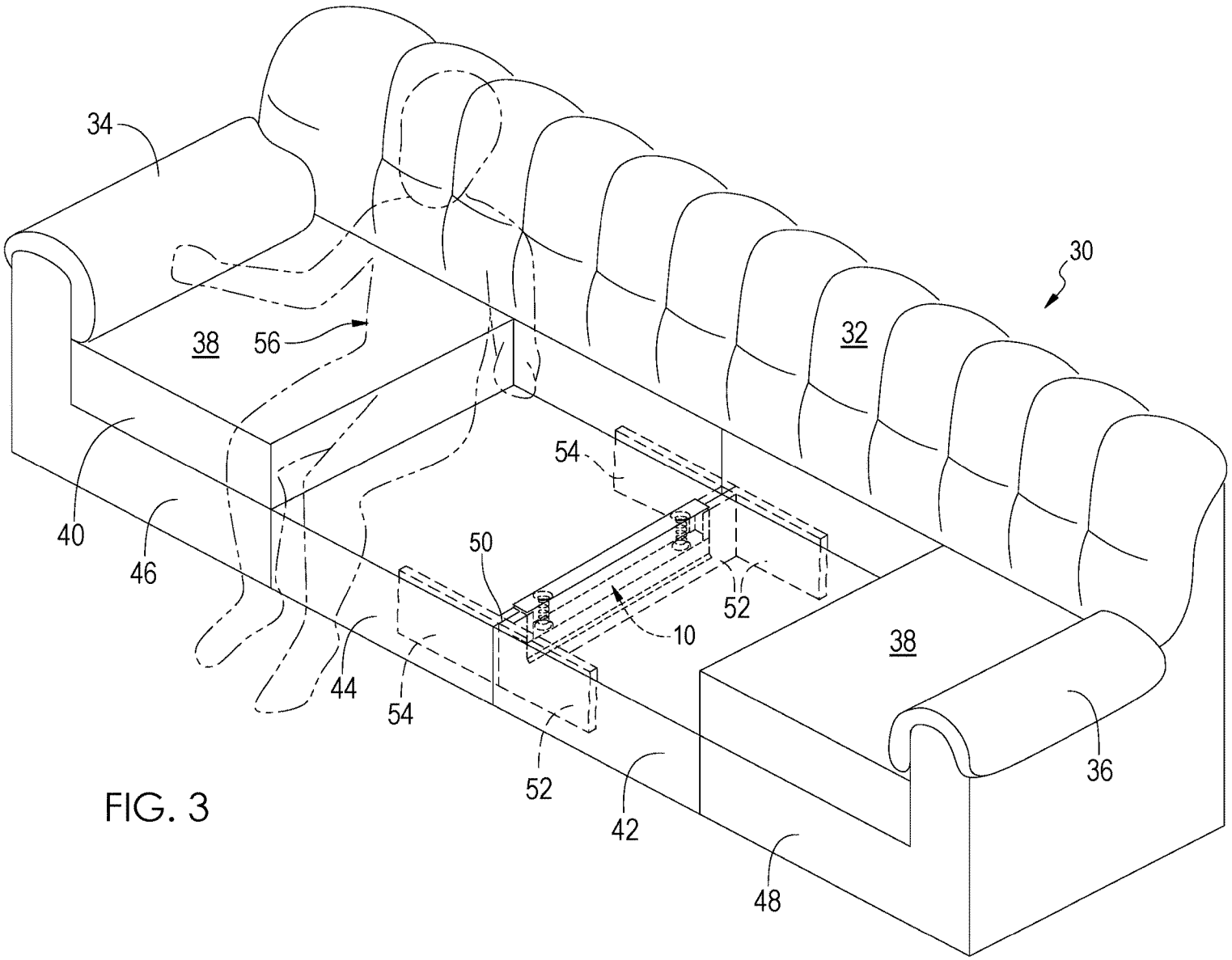
FIG. 3 is a front perspective view of the present invention shown in operative connection on an exemplary piece of furniture.

Turning to FIG. 3, therein is shown an environmental view illustrating the present invention 10 installed on a sofa 30 being conventional in nature having a back portion 32 and first and second end arm portions 34, 36 and providing a general seating area 38 wherein the seating area is provided with cushions 40 extending across its upper portion for use by a user 56. FIG. 3 is drawn so that some of the cushions 40 are removed for sake of clarity; of course, in normal practice all the cushions 40 would be in place positioned side-to-side across the sofa 30 so that the present invention 10 would be underneath the cushions. The sofa 30 is comprised of a minimum of a first section 42 and a second section 44 and also has additional first and second end pieces 46, 48. An abutting seam or joint 50 is formed between the first and second sections 42, 44 wherein the seam/joint is clearly visible on all edges between the two sections 42, 44 with the present invention 10 shown disposed along the seam/joint 50 so that the seam/joint is filled so that when a user sits down on the sofa 30 the discomfort he normally feels due to lack of support along the abutting seam/joint 50 between the first and second sections 42, 44 is not felt due to the presence of the present invention 10 wherein the top plate 12 is provided in order to fill and form a cushion in the seam/joint 50 which occurs between the first and second sections 42, 44. The adjoining sections 42-44 of the sectional furniture are each manufactured with lower frame members around their perimeter so that there are frame members on the front, rear, and sides including first and second frame members 52, 54 which are the frame members to which the present invention 10 is attached. Top plate 12 is about level with the upper edges of frame members 52, 54 when it is not depressed due to the weight of a user 56.

Figure 4:
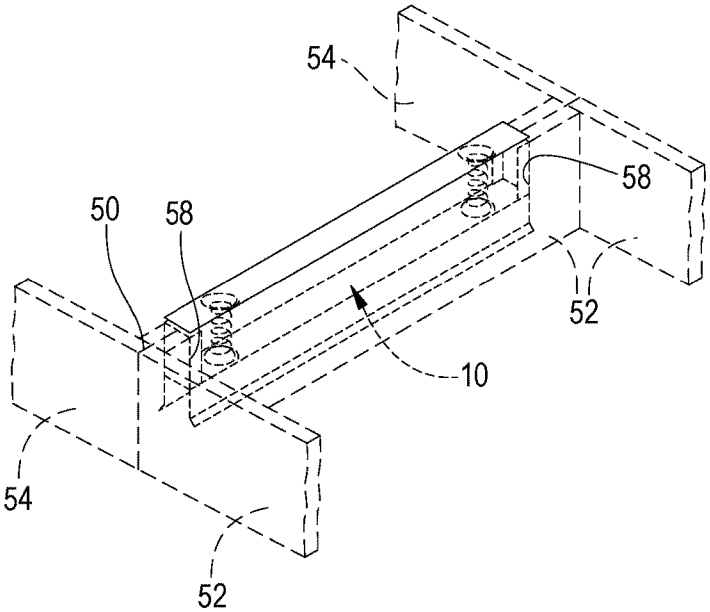
FIG. 4 is an enlarged front perspective view taken from FIG. 3 of the present invention shown in operative connection on an exemplary piece of furniture.

Turning to FIG. 4 is an enlarged view taken from FIG. 3 of the present invention 10 disposed in notch 58 on the first and second frame members 52, 54. The notch 58 is cut or scalloped into the frame members 52, 54 and is sized to receive the present invention 10 therein so that the top plate 12 of the present invention 10 is approximately level or flush with the upper edges of the first and second frame members 52, 54.

Figure 5:
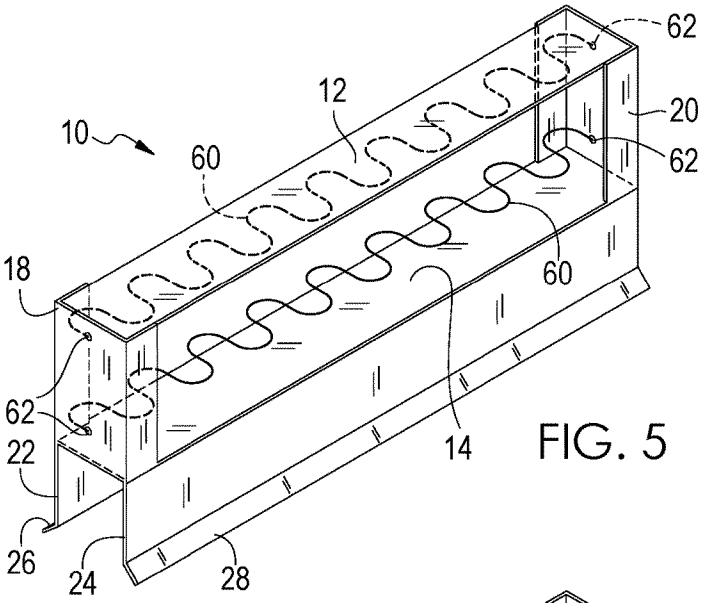
FIG. 5 is a perspective view of the present invention shown with sinuous springs.

Turning to FIG. 5, therein is shown the present invention 10 in a view similar to FIG. 1 wherein the resilient member is a sinuous wire spring 60 having end connections 62 on each end thereof so that the ends of the sinuous wire springs can be connected to the end supports 18, 20 so that the sinuous wire spring can cushion the top plate 12.

Figure 6:
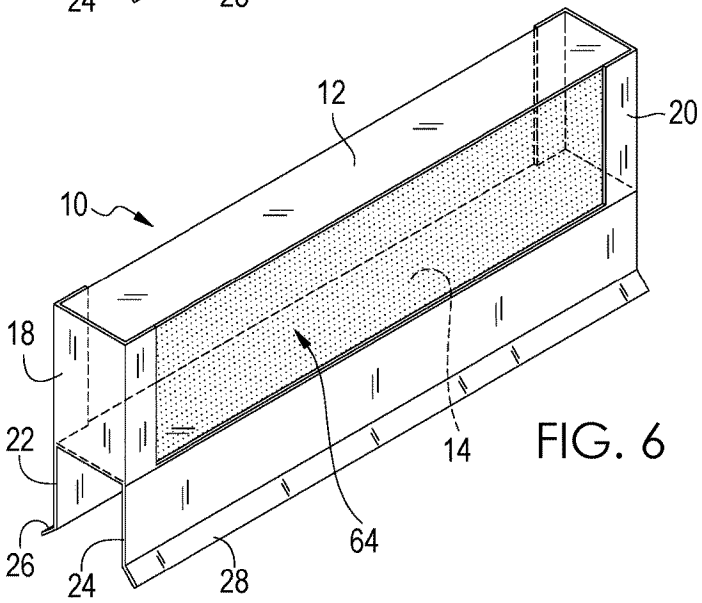
FIG. 6 is a perspective view of the present invention shown with foam.

Turning to FIG. 6, therein is shown the present invention 10 in a view similar to FIG. 1 wherein the resilient member is a piece of foam material 64. Many types of foam material 64 could be used in this particular application as would be understood by one skilled in the art. For example, there are several types of polyurethane foam having a range of density including conventional foam and high-resiliency foam which might be used in this particular application.

By way of further explanation of the present invention 10, and by making reference to FIGS. 1-3, traditional sectionals, modular groups, and basically all current e-commerce upholstered furniture companies build furniture in which the seating area 38 is comprised of a seat box that contains sinuous wire springs 60. They are attached to a clip at both front and back and those springs 60 flex downward when there is weight applied as when a user 56 sits on them and then they rebound to normal position when there is no weight applied. On these items, a seat box will be joined to another seat box either by a connector or the pieces will just be aligned. Where each seat box meets is a piece of plywood that acts as an outside border but when someone 56 sits to the side of the cushion or lays down, they can feel it. The feel is obviously hard and completely inconsistent with the feel of the rest of the seat. The present invention 10 eliminates the feel of the hard plywood edge on the side of the seat box by replacing the plywood edge with an upholsterable edge that also will make the furniture have a continuous comfortable seat. It may also contain a way to align and secure the pieces together by perhaps magnets, or otherwise. However, the main function of the system of the present invention 10 is to eliminate the discomfort of feeling the individual boxes. The present invention 10 solves an existing problem and provides an edge that can be upholstered.

The present invention 10 is expected to be manufactured of light gauge metal, or the like, except for the top plate 12 which may be made of plastic, or the like. While the present invention 10 is illustrated as having an elongated rectangular shape when viewed from the top, it could have other shapes to match the shape of the joint between adjacent pieces or modules of modular furniture.

By way of additional summary and by making reference to FIGS. 1-6, the present invention 10 provides a method for filling the joint 50 between abutting pieces of modular furniture 44, 42 including a top plate 12 having first and second ends and an underside, shaping the top plate to be generally rectangular shaped to conform to the shape of the joint; providing a support plate 14 disposed underneath the top plate, wherein the support plate has first and second ends and an upper side, shaping the support plate to be generally rectangular shaped to conform to the shape of the top plate; mounting first and second end supports 18, 20 on corresponding ends of the support plate, wherein the end supports form opposing inwardly disposed U-channels for receiving the ends of the top plate therein so that the top plate is slidable in the first and second end support in response to a user 56 sitting on the abutting pieces of modular furniture; placing a resilient member 16, 60, 64 extending between the underside of the top plate and the upper side of the support plate so that the resilient member provides cushioning to the top plate as the top plate slides in the first and second end supports; and adapting the support plate for mounting onto abutting frame members 54, 52 of abutting pieces of modular furniture.

Also, providing a downwardly disposed U-channel on an underside of the support plate, wherein each side of the U-channel forms a leg 22, 24 wherein abutting frame members of abutting pieces of modular furniture can be received between the legs of the downwardly disposed U-channel, wherein a lower end of the first and second end supports are disposed onto the upper side of the support plate, providing a foot 26, 28 being downwardly disposed on a lower end of each leg, wherein each foot is outwardly disposed away from each other to assist in sliding the legs over the abutting frame members of abutting pieces of modular furniture, notching at 58 abutting frame members of abutting pieces of modular furniture for receiving the legs of the downwardly disposed U-channel therein, and wherein the resilient member is selected from the group consisting of a coiled spring 16, a sinuous spring 60, and a foam 64.

I claim:

1. An apparatus for filling the joint between abutting pieces of modular furniture, comprising:

a) a top plate having first and second ends and an underside, wherein said top plate is generally rectangular shaped to conform to the shape of the joint;

b) a support plate disposed underneath said top plate, wherein said support plate has first and second ends and an upper side, wherein said support plate is generally rectangular shaped to conform to the shape of said top plate;

c) first and second end supports disposed on corresponding ends of said support plate, wherein said end supports form opposing inwardly disposed U-channels for receiving said ends of said top plate therein, wherein said top plate is slidable in said first and second end support in response to a user sitting on the abutting pieces of modular furniture;

d) a resilient member extending between said underside of said top plate and said upper side of said support plate, wherein said resilient member provides cushioning to said top plate as said top plate slides in said first and second end supports; and e) wherein said support plate is adapted for mounting onto abutting frame members of abutting pieces of modular furniture.

2. The apparatus of claim 1, further comprising a downwardly disposed U-channel on an underside of said support plate, wherein each side of said U-channel forms a leg wherein abutting frame members of abutting pieces of modular furniture can be received between said legs of said downwardly disposed U-channel.

3. The apparatus of claim 2, wherein a lower end of said first and second end supports are disposed onto said upper side of said support plate.

4. The apparatus of claim 3, further comprising a foot being downwardly disposed on a lower end of each said leg, wherein each said foot is outwardly disposed away from each other to assist in sliding said legs over said abutting frame members of abutting pieces of modular furniture.

5. The apparatus of claim 4, wherein said resilient member is selected from the group consisting of a coiled spring, a sinuous spring, and a foam.

6. The apparatus of claim 4, wherein said top plate is made of plastic.

7. The apparatus of claim 4, wherein the apparatus is made of metal.

8. The apparatus of claim 4, wherein said abutting frame members of abutting pieces of modular furniture are notched for receiving said legs of said downwardly disposed U-channel therein.

9. A method for filling the joint between abutting pieces of modular furniture, comprising the steps of:

a) providing a top plate having first and second ends and an underside, shaping the top plate to be generally rectangular shaped to conform to the shape of the joint;

b) providing a support plate disposed underneath the top plate, wherein the support plate has first and second ends and an upper side, shaping the support plate to be generally rectangular shaped to conform to the shape of the top plate;

c) mounting first and second end supports on corresponding ends of the support plate, wherein the end supports form opposing inwardly disposed U-channels for receiving the ends of the top plate therein so that the top plate is slidable in the first and second end support in response to a user sitting on the abutting pieces of modular furniture;

d) placing a resilient member extending between the underside of the top plate and the upper side of the support plate so that the resilient member provides cushioning to the top plate as the top plate slides in the first and second end supports; and e) adapting the support plate for mounting onto abutting frame members of abutting pieces of modular furniture.

10. The method of claim 9, further comprising the step of providing a downwardly disposed U-channel on an underside of the support plate, wherein each side of the U-channel forms a leg wherein abutting frame members of abutting pieces of modular furniture can be received between the legs of the downwardly disposed U-channel.

11. The method of claim 10, wherein a lower end of the first and second end supports are disposed onto the upper side of the support plate.

12. The method of claim 11, further comprising the step of providing a foot being downwardly disposed on a lower end of each leg, wherein each foot is outwardly disposed away from each other to assist in sliding the legs over the abutting frame members of abutting pieces of modular furniture.

13. The method of claim 12, further comprising the step of notching abutting frame members of abutting pieces of modular furniture for receiving the legs of the downwardly disposed U-channel therein.

14. The method of claim 12, wherein the resilient member is selected from the group consisting of a coiled spring, a sinuous spring, and a foam.

15. The method of claim 12, wherein the top plate is made of plastic.

16. The method of claim 12, wherein the apparatus is made of metal.

* * * * *